United States Patent [19]

Sugimoto et al.

[11] Patent Number: 4,471,630

[45] Date of Patent: Sep. 18, 1984

[54] COOLING SYSTEM HAVING COMBINATION OF COMPRESSION AND ABSORPTION TYPE UNITS

[75] Inventors: Shigeo Sugimoto; Ryohei Minowa, both of Ibaraki, Japan

[73] Assignee: Hitachi, Ltd., Tokyo, Japan

[21] Appl. No.: 461,567

[22] Filed: Jan. 27, 1983

[30] Foreign Application Priority Data

Jan. 29, 1982 [JP] Japan ..... 11612

[51] Int. Cl.[3] ..... F25B 7/00

[52] U.S. Cl. ..... 62/175; 62/333; 62/335; 62/476

[58] Field of Search ..... 62/175, 335, 332, 333, 62/476, 141

[56] References Cited

U.S. PATENT DOCUMENTS

| | | | |
|---|---|---|---|
| 3,301,000 | 1/1967 | Holbay | 62/141 |
| 3,824,804 | 7/1974 | Sandmark | 62/335 |
| 4,374,468 | 2/1983 | Takeshita et al. | 62/335 X |

*Primary Examiner*—Lloyd L. King

*Attorney, Agent, or Firm*—Antonelli, Terry & Wands

[57] ABSTRACT

A cooling system including a compression refrigeration unit and an absorption refrigeration unit, with the compression refrigeration unit including a compressor having a capacity control mechanism; a condenser for cooling and condensing a compressed refrigerant gas through a heat exchange between the refrigerant gas and a cooling medium circulated through the condenser; and an evaporator into which the condensed refrigerant is introduced through an expansion means so as to be evaporated and cool a medium by the latent heat derived from evaporation. The absorption refrigeration unit includes a generator having a capacity control mechanism for heating a solution to generate a vapor of a refrigerant and a strong solution; a condenser in which the vapor of refrigerant generated in the generator is cooled and condensed an evaporator in which the refrigerant in the condenser is evaporated and cools a medium to be cooled by latent heat from the evaporation; an absorber in which the vapor of refrigerant is absorbed by the strong solution generated and forms a weak solution; and a pump for feeding the weak solution to the generator. The compression refrigeration unit and the absorption refrigeration unit are connected so that at least the medium to be cooled and the cooling medium first flows into the compression refrigeration unit and then into the absorption refrigeration unit.

8 Claims, 3 Drawing Figures

COOLING SYSTEM HAVING COMBINATION OF COMPRESSION AND ABSORPTION TYPE UNITS

BACKGROUND OF THE INVENTION

The present invention relates to a cooling system including a compression type refrigeration unit and an absorption type refrigeration unit, suitable for use in air conditioners, for chilling of fluids or goods, and so forth.

As shown in FIG. 1, in a known cooling system including a compression type refrigeration unit generally designated by the reference character A and an absorption type refrigeration unit generally designated by the reference character B, the refrigeration units A, B are constructed as separate or independent refrigeration units or, alternatively, arranged in a so-called series system in which the medium 15 to be cooled (cold water) of a comparatively high temperature is cooled down by the evaporator 5 of the absorption type refrigeration unit B and is further cooled by the evaporator 4 of the compression type refrigeration unit A. On the other hand, the cooling medium 14 (cooling water) is circulated through the condenser 2 of the compression type refrigeration unit A and the absorber 6 and the condenser 8 of the absorption type refrigeration unit B. However, when the temperature difference between the cold water 15 and the cooling water 14 is small, the compression type refrigeration unit A provides greater energy saving effect than the absorption type refrigeration unit B, so that the above-explained series arrangement is not preferred from the view point of energy conservation.

SUMMARY OF THE INVENTION

Accordingly, an object of the invention is to provide a cooling system having a combination of a compression type refrigeration unit and an absorption type refrigeration unit, in which the compression type refrigeration unit and the absorption type refrigeration unit are combined in such a manner so as to attain an efficient use of energy, i.e. energy conservation.

Another object of the invention is to provide a cooling system, improved to provide a greater range of operation in which the compression type refrigeration unit can operate without surging.

To this end, according to the invention, there is provided a cooling system including a compression type refrigeration unit and an absorption type refrigeration unit, wherein the compression type refrigeration unit includes: a compressor having a capacity control mechanism; a condenser for cooling and condensing a refrigerant gas compressed by the compressor through heat exchange between the refrigerant gas and a cooling medium circulated through the condenser; and an evaporator into which the condensed refrigerant is introduced through an expansion means, with the refrigerant then being evaporated and cooling a medium to be cooled by the latent heat derived from the evaporation. The absorption type refrigeration unit includes: a generator having a capacity control mechanism and adapted to heat a solution thereby to generate the vapor of a refrigerant and a strong solution; a condenser in which the vapor of refrigerant generated in the generator is cooled and condensed through heat exchange with a cooling medium; an evaporator in which the refrigerant condensed in the condenser being evaporated and cooling a medium to be cooled by the latent heat derived from the evaporation; an absorber in which the vapor of refrigerant generated in the evaporator is absorbed by a strong solution generated in the generator to thereby form a weak solution; and a pump adapted to feed the weak solution generated in the absorber to the generator. The compression type refrigeration unit and the absorption type refrigeration unit are connected to each other in such a manner that at least the medium to be cooled out of the medium to be cooled and the cooling medium first flow into the compression type refrigeration unit and, after coming out of the compression type refrigeration unit, into the absorption type refrigeration unit.

These and other objects, features and advantages of the invention will become clear from the following description of the preferred embodiments taken in conjunction with the accompanying drawings.

DESCRIPTION OF THE PREFERRED EMBODIMENTS

Figure 2:
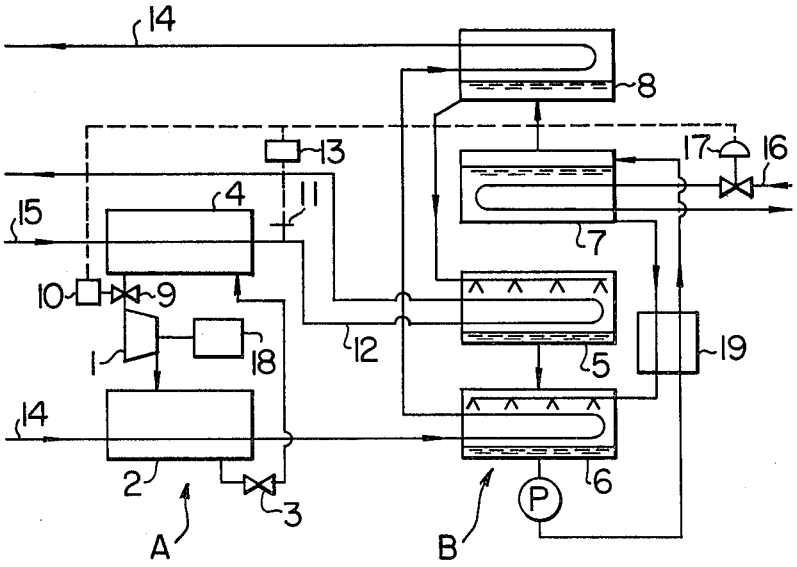
FIG. 2 is a schematic diagram of a cooling system in accordance with one embodiment of the present invention.

Referring to FIG. 2, a compression type refrigeration unit A has a centrifugal compressor 1, condenser 2, expansion means 3 and an evaporator 4, while an absorption type refrigeration unit B is constituted by an evaporator 5, absorber 6, generator 7 and a condenser 8. Capacity control valves 9 annexed to the compressor 1, are adapted to be driven by a motor 10.

A temperature detector 11 is disposed in the passage 12 for medium to be cooled (cold water) connected between the evaporator 4 of the compression type refrigeration unit A and the evaporator 4 of the absorption type refrigeration unit B or at the outlet of the evaporator 4. A temperature controller 13 is connected to the temperature detector 11, motor 10 and a control valve 17. The temperature controller 13 is adapted to generate a signal for maintaining a substantially constant temperature of the cold water, with the motor 10 and the control valve 17 being operated in accordance with this signal.

A cooling medium (cooling water) 14 is circulated through the condenser 2 of the compression type refrigeration unit A and the absorber 6 and the condenser 8 of the absorption type refrigeration unit B successively, while a medium to be cooled (cold water) 15 is circulated through the evaporator 4 of the compression type refrigeration unit A and the evaporator 5 of the absorption type refrigeration unit B. A control valve 17 is disposed in the passage 16 for supplying a heating medium. A prime mover 18 drives the compressor 1, with the absorption type refrigeration unit B further including a heat exchanger 19 and a pump P.

The cooling system of the described embodiment operates in the following manner:

In this embodiment, Freon 11 (R11) or Freon 12 (R12) is used as the refrigerant circulated in the compression type refrigeration unit A. The gas of this refrigerant is compressed by the centrifugal compressor 1 which is driven by the prime mover 18. The compressed gas is introduced into the condenser 2 and is cooled and condensed by the cooling medium (cooling water) circulated through the condenser 2. The refrigerant condensed into liquid phase in the condenser is then introduced, through an expansion means 3, into an evaporator 4 where the refrigerant is evaporated and cools the medium 15 to be cooled circulated through the evaporator 4 by the latent heat derived from the evaporation. The refrigerant gas generated as a result of the evaporation is introduced into the centrifugal compressor 1 through a capacity control effected by the capacity control valves 9 which, in turn, are driven by the motor 10 under the control of the temperature controller 13. Then, the refrigerant is compressed and the refrigeration cycle explained above is repeated.

On the other hand, the absorption type refrigeration unit B makes use of an aqueous solution of lithium bromide. In the generator 7, the solution is heated by the heating medium which is supplied into the generator 7 from the heating medium supplying passage 16 at a flow rate controlled by a control valve 17. Consequently, the water serves as the refrigerant for the absorption type refrigerant vapor (water vapor) and strong solution of lithium bromide. The refrigerant vapor is introduced into the condenser 8 so as to be cooled and condensed by the cooling medium (cooling water) circulated through the condenser 8. The refrigerant (water) generated as a result of condensation in the condenser 8 is then introduced into the evaporator 5 being evaporated and cooling the medium 15 to be cooled circulated through the evaporator 5 by the latent heat derived from the evaporation. The evaporated refrigerant is then introduced into the absorber 6 which receives also the strong solution generated in the generator 7 through the heat exchanger 19. In the absorber 6, the refrigerant vapor and the strong solution are cooled by the cooling medium (cooling water) 14 circulated through the absorber so that the refrigerant vapor is absorbed by the strong solution to form a weak solution. The weak solution generated in the absorber is returned to the generator 7 through the heat exchanger 19 by means of the pump P, and the cycle explained above is repeated.

In the described embodiment, Freon 11 (R11) or Freon 12 (R12) is used as the refrigerant for the compression type refrigeration unit A, while an aqueous solution of lithium bromide is used as the refrigerant for the absorption type refrigeration unit B. These refrigerants, however, are not exclusive and the cooling system of the invention can use any suitable other refrigerant or solution.

The cooling medium (cooling water) is gradually heated as it flows through the condenser 2 of the compression type refrigeration unit A, and the absorber 6 and the condenser 8 of the absorption type refrigeration unit B. The thus heated cooling water is introduced to a cooling tower (not shown) where it is cooled and then supplied again to the cooling system in which the compression type refrigeration unit A and the absorption type refrigeration unit B are combined, so that the refrigeration cycles are repeated in the manner explained above. The medium 15 to be cooled (cold water) is cooled through the evaporator 4 of the compression type refrigeration unit A. The temperature of the medium 15 to be cooled (cold water) is detected by the temperature detector 11 at the outlet side of the evaporator 4. The temperature detector 11 produces a signal representative of the temperature of the medium 15 to be cooled to the temperature controller 13 which, in turn, effects the capacity control of the compressor 1 through adjustment of the capacity control valves 9 which are driven by the motor 10 under the control of the temperature controller 13, to thereby control the flow rate of the refrigerant introduced from the evaporator 4 into the centrifugal compressor so as to maintain a constant temperature of the medium 15 to be cooled. The cooled medium 15 is then circulated through and further cooled in the evaporator 5 of the absorption type refrigeration unit B and is then introduced to the cooling load (not shown) so as to cool the same. The cooled medium (cold water), which is heated to a higher temperature as a result of cooling of the load, is then returned to the evaporator 4 of the compression type refrigeration unit A and the above described cycle is repeated.

Figure 1:
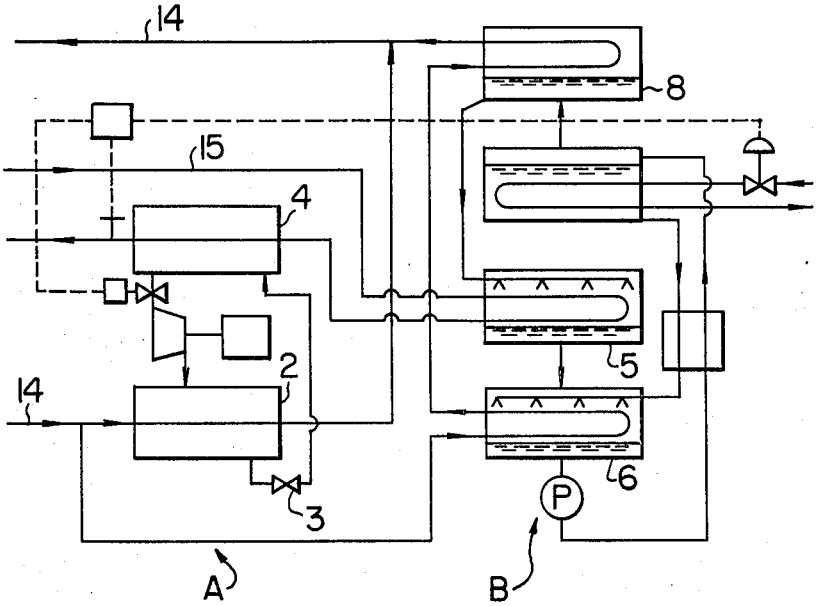
FIG. 1 PRIOR ART
FIG. 1 is a schematic diagram of a conventional cooling system.

In the rated operation of the cooling system A, the temperature difference between the cooling water 14 and the cold water 15 is much smaller than that in the conventional system shown in FIG. 1 so that the energy is remarkably conserved in the compression type refrigeration A in proportion to the reduction in the temperature difference.

On the other hand, when the cooling power of the compression type refrigeration unit A is smaller than the demanded cooling power, the temperature of the cold medium 15 is raised. To the contrary, if the cooling power of the compression type refrigerator A is excessive, the temperature of the cold medium 15 is lowered. This variation is detected by the temperature detector 11, and the temperature controller 13 operates in response to the output from the temperature detector 11 so as to control the motor 10 for driving the capacity control valves 9 and also the control valve 17. As a result of this operation, the cooling powers of the refrigeration units A and B to make the actual cooling power coincide with the demanded cooling load. In this case, the control is made such that the cooling powers the compression type refrigeration unit A and the absorption type refrigeration unit B are varied in response to a change in the demanded cooling power in a manner shown more clearly in FIG. 3.

Namely, while the cooling load is still small, only the compression type refrigeration unit A operates while the operation of the absorption type refrigeration unit B is suspended. According to this arrangement, the angle of the capacity control valves 9 of the compressor are changed by the temperature controller 13 substantially in proportion to the increase or decrease of the cooling load. As the cooling load demand increased to reach a predetermined limit, the opening degree of the capacity control valves 9 is increased to 100% so that the compression type refrigeration unit A operates at the rated power, i.e. with full load. Then, as the cooling load demand is increased to exceed the above-mentioned predetermined limit, the temperature of the medium to be cooled (cold water) is increased so that the control valve 17 of the absorption type refrigeration unit B is opened by the action of the temperature controller 13 so that the heating medium is introduced into the generator 8 through the heating medium supply passage 16. As a result, the absorption type refrigeration unit B operates with its cooling power varied by a change in the opening degree of the control valve 17 in accordance with the increase or decrease of the part of the cooling exceeding the above-mentioned predetermined limit.

Figure 3:
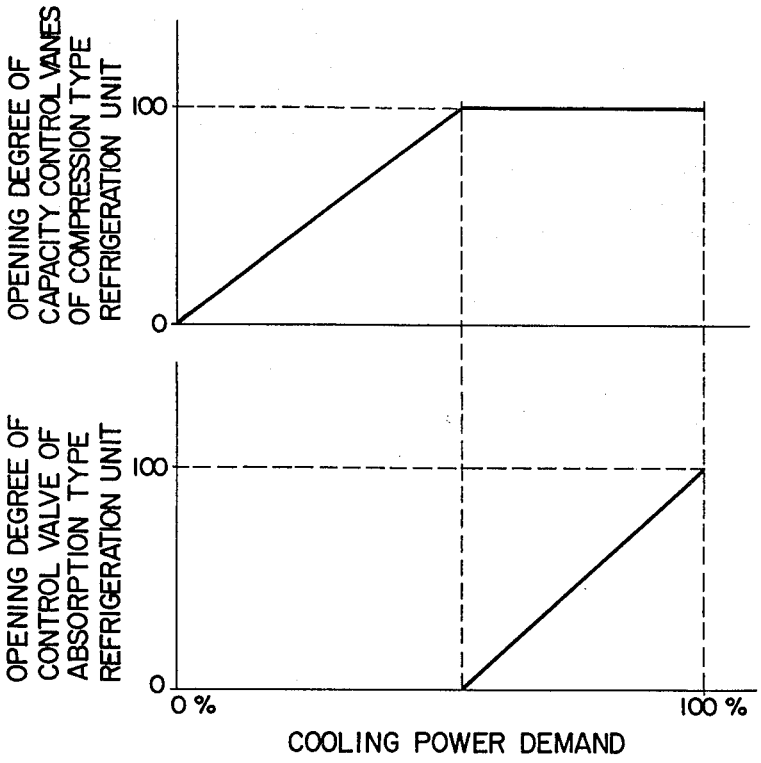
FIG. 3 is a graphical illustration of the relationship between a required cooling load and a valve opening degree in a compression-type refrigeration unit and an absorption-type refrigeration unit.

Namely, as the cooling load exceeds the predetermined limit which is shown by the vertical broken line at the center of FIG. 3, the compression type refrigeration unit A operates with 100% opening of the capacity control valves 9, i.e. at the rated or full load, while the absorption type refrigeration unit B operates in such a manner that its capacity or cooling power is increased or decreased in accordance with the part of the cooling load above the predetermined limit.

Therefore, provided that the ratio of the cooling power of the compression type refrigeration unit A to the total cooling power provided by the compression type refrigeration unit A and the absorption type refrigeration unit B is selected adequately, the compression type refrigeration unit A can operate with its rated load over almost entire part of operation period of the cooling system, except the case where the cooling load is very small. According to the invention, it is thus possible to operate the compression type refrigeration unit A at a remarkably high efficiency.

The temperature controller 13 is constructed to maintain a substantially constant temperature of the cold medium flowing from the evaporator 4 of the compression type refrigeration unit A and the evaporator 5 of the absorption type refrigeration unit B, i.e. a substantially constant temperature of the cold medium coming out from the compression type refrigeration unit A. Conventionally, this control is made in such a manner as to maintain a constant temperature of the cold medium coming out of the whole cooling system, i.e. at the outlet of the absorption type refrigeration unit B. However, when the cooling power demand is small or the operation of the absorption type refrigeration unit B is suspended, the temperature of the cold medium coming from the compression type refrigeration unit A becomes considerably lower than that obtained in the operation at the rated load. In general, when the compression ratio is increased beyond a predetermined value, a phenomenon called "surging" takes place in the centrifugal compressor to produce large noise and vibration. The fact that the temperature difference between the cooling medium and the cold medium becomes large when the load is much smaller than the rated capacity means that the margin for surging is disadvantageously decreased. However, according to the invention, the temperature difference between the cooling medium and the cold medium is not increased even when the load is small, so that the above-described inconvenience is advantageously avoided.

In the cooling system of the invention it is preferred to provide a control valve (not shown) which make both of the medium to be cooled (cold water) and the cooling medium (cooling water) flow by-passing or detouring the absorption type refrigeration unit B when the latter is not operating due to a small cooling load demand.

What is claimed is:

1. A cooling system including a compression type refrigeration unit and an absorption type refrigeration unit, said compression type refrigeration unit includes: a compressor having a capacity controlled mechanism; a condenser means for cooling and condensing a refrigerant gas compressed by said compressor through a heat exchange between said refrigerant gas and a cooling medium circulated through said condensor means; and an evaporator means for receiving the condensed refrigerant through an expansion means, the refrigerant being evaporated and cooling a medium to be cooled by latent heat derived from the evaporation; said absorption type refrigeration unit includes: a generator means having a capacity control mechanism for heating a solution to thereby generate a vapor of a refrigerant and a strong solution; a condensor means for cooling said vapor of said refrigeran generated in said generator and for condensing said vapor through a heat exchange with a cooling medium; an evaporator means for evaporating said refrigerant condensed in said condensor means and for cooling a medium to be cooled by latent heat derived from the evaporation; and an absorber means for absorbing the vapor of said refrigerant generated in said evaporator means by said strong solution generated in said generator means to thereby form a weak solution; and a pump means for feeding the weak solution generated in the absorber means to said generator means; and means for connecting said compression type refrigeration unit and said absorption type refrigeration unit to each other in such a manner that at least said medium to be cooled and said cooling medium first flows into said compression type refrigeration unit and, after coming out of said compression type refrigeration unit, into said absorption type refrigeration unit.

2. A cooling system according to claim 1, wherein said connecting means enables the cooling medium to sequentially flow through said condenser means of said compression type refrigeration unit, absorber means of said absorption type refrigeration unit, and then through said condenser means of said absorption type refrigeration unit.

3. A cooling system according to claim 1, wherein said connecting means enables the medium to be cooled to first flow through said evaporator means of said compression type refrigeration unit and then through said absorption type refrigeration unit.

4. A cooling system according to claim 2, wherein said connecting means enables the medium to be cooled to flow first through said evaporator means of said compression type refrigeration unit and then through said absorption type refrigeration unit.

5. A cooling system according to claim 1, further comprising a temperature detector means disposed at an outlet for said medium to be cooled for detecting the temperature thereof, and a temperature controller means connected to said temperature detector means for cotrolling the operation of said capacity control mechanism in said compression type refrigeration unit and said absorption type refrigeration unit.

6. A cooling system according to claim 5, further comprising means for operating said compression type refrigeration unit only when the cooling power demand is less than a predetermined limit within the total cooling power of said cooling system and for starting operation of said absorption type refrigeration unit to increase the cooling power when said cooling power demand is increased beyond said predetermined limit.

7. A cooling system according to claim 6, wherein said temperature controller means operates in response to a signal from said temperature detector means in such a manner so as to operate said capacity control mechanism of said compression type refrigeration unit to limit the capacity of the latter, when the cooling power demand does not reach a predetermined limit within the cooling capacity of said cooling system.

8. A cooling system according to claim 6, wherein said connecting means enables the cooling medium to flow through said condenser means of said compression type refrigeration unit, then through said absorber means of said absorption type refrigeration unit, and then through said condenser means of said absorption type refrigeration unit, while said medium to be cooled flows first through said evaporator means of said compression type refrigeration unit and then through the evaporator means of said absorption type refrigeration unit.

* * * * *